US011100848B2

(12) United States Patent
Yen et al.

(10) Patent No.: US 11,100,848 B2
(45) Date of Patent: Aug. 24, 2021

(54) DISPLAY SYSTEM AND DRIVING CIRCUIT THEREOF

(71) Applicant: MACROBLOCK, INC., Hsinchu (TW)

(72) Inventors: Hung-Lin Yen, Hsinchu (TW); Shun-Ching Hsieh, Hsinchu (TW)

(73) Assignee: MACROBLOCK, INC., Hsinchu (TW)

( * ) Notice: Subject to any disclaimer, the term of this patent is extended or adjusted under 35 U.S.C. 154(b) by 0 days.

(21) Appl. No.: 16/822,715

(22) Filed: Mar. 18, 2020

(65) Prior Publication Data

US 2020/0312233 A1 Oct. 1, 2020

(30) Foreign Application Priority Data

Mar. 28, 2019 (TW) ..... 108111061

(51) Int. Cl.
*G09G 3/32* (2016.01)
*G09G 3/20* (2006.01)

(52) U.S. Cl.
CPC ..... *G09G 3/32* (2013.01); *G09G 3/2003* (2013.01); *G09G 2310/0267* (2013.01); *G09G 2310/08* (2013.01); *G09G 2320/064* (2013.01)

(58) Field of Classification Search
CPC ..... G09G 3/32; G09G 3/2003; G09G 2310/0267; G09G 2310/08; G09G 2320/064
See application file for complete search history.

(56) References Cited

U.S. PATENT DOCUMENTS

| | | | | |
|---|---|---|---|---|
| 7,532,029 | B1 | 5/2009 | Asaduzzaman et al. | |
| 8,854,293 | B2 | 10/2014 | Seong et al. | |
| 2007/0152923 | A1 | 7/2007 | Baik et al. | |
| 2010/0020004 | A1 | 1/2010 | Smith | |
| 2011/0074799 | A1* | 3/2011 | Wu | G09G 3/3216 345/532 |
| 2011/0096106 | A1 | 4/2011 | Nomaguchi et al. | |

(Continued)

FOREIGN PATENT DOCUMENTS

| | | |
|---|---|---|
| CN | 109360526 A | 2/2019 |
| CN | 109377938 A | 2/2019 |

(Continued)

OTHER PUBLICATIONS

Search Report issued to European counterpart application No. 20162391.5 by the EPO dated May 13, 2020.

(Continued)

*Primary Examiner* — Peter D McLoone
(74) *Attorney, Agent, or Firm* — Akerman LLP; Peter A. Chiabotti

(57) ABSTRACT

A display system includes a light emitting array and a driving circuit. The light emitting array includes: a plurality of scan lines, a plurality of channel lines, and a plurality of light emitting elements connected to the scan lines and the channel lines. The driving circuit includes: a delay-locked loop generating an internal global clock signal; a signal processor generating a scan control output and a channel control output based on the internal global clock signal and display data; a scan driver driving the scan lines based on the scan control output; and a channel driver providing a plurality of driving current signals respectively to the channel lines based on the channel control signal.

20 Claims, 12 Drawing Sheets

(56) References Cited

U.S. PATENT DOCUMENTS

| | | | |
|---|---|---|---|
| 2011/0121755 | A1 | 5/2011 | Han |
| 2012/0206430 | A1 | 8/2012 | Li et al. |
| 2014/0153935 | A1 | 6/2014 | Uo |
| 2016/0189625 | A1 | 6/2016 | Kim et al. |
| 2018/0182279 | A1 | 6/2018 | Sakariya et al. |

FOREIGN PATENT DOCUMENTS

| | | | |
|---|---|---|---|
| EP | 3040962 | A1 | 7/2016 |
| JP | 2014038185 | A | 2/2014 |
| JP | 2016504619 | A | 2/2016 |
| KR | 20130086433 | A | 8/2013 |
| TW | 201203207 | A | 1/2012 |

OTHER PUBLICATIONS

Search Report issued to European counterpart application No. 20162391.5 by the EPO dated Sep. 8, 2020.
Taiwan Intellectual Property Office, "Search Report," and English translation thereof, issued in Taiwan Patent Application No. 108111061, dated Feb. 5, 2020, document of 2 pages.
Office Action issued to Japanese counterpart application No. 2020054939 by the JPO dated Mar. 9, 2021 (with translation).

* cited by examiner

DISPLAY SYSTEM AND DRIVING CIRCUIT THEREOF

CROSS-REFERENCE TO RELATED APPLICATION

This application claims priority of Taiwanese Patent Application No. 108111061, filed on Mar. 28, 2019.

FIELD

The disclosure relates to display techniques, and more particularly to a display system and a driving circuit thereof.

BACKGROUND

A light emitting diode (LED) driver chip conventionally utilizes a phase-locked loop (PLL) to generate a global clock signal that is to be used therein. The PLL is generally implemented using analog circuits, so: it occupies a large area; and it has to be dramatically adjusted in circuit parameters and/or circuit architecture when a semiconductor process for fabricating the LED driver chip is changed, which consumes significant amounts of human resources and time.

Moreover, a common-anode LED driver chip, which is used to drive an LED array with a common anode configuration, conventionally has circuit architecture different from that of a common-cathode LED driver chip, which is used to drive an LED array with a common cathode configuration. It consumes significant amounts of human resources and time to design these LED driver chips separately.

SUMMARY

Therefore, an object of the disclosure is to provide a display system and a driving circuit thereof. The driving circuit can alleviate at least one drawback of the prior art.

According to an aspect of the disclosure, the display system includes a light emitting array and a driving circuit. The light emitting array includes a plurality of scan lines, a plurality of channel lines, and a plurality of light emitting elements that are arranged in a matrix with a plurality of rows and a plurality of columns. For each of the rows of the light emitting elements, the light emitting elements are connected to a respective one of the scan lines. For each of the columns of the light emitting elements, the light emitting elements are connected to a respective one of the channel lines. The driving circuit includes a delay-locked loop (DLL), a signal processor, a scan driver and a channel driver. The DLL is for receiving a reference clock signal, and generates an internal global clock signal based on the reference clock signal. The signal processor is connected to the DLL for receiving the internal global clock signal therefrom, is for further receiving display data, and generates a scan control output and a channel control output based on the internal global clock signal and the display data. The scan driver is connected to the scan lines, is further connected to the signal processor for receiving the scan control output therefrom, and drives the scan lines based on the scan control output. The channel driver is connected to the channel lines, is further connected to the signal processor for receiving the channel control output therefrom, and provides a plurality of driving current signals respectively to the channel lines based on the channel control output.

According to another aspect of the disclosure, the driving circuit is operatively associated with a light emitting array.

The light emitting array includes a plurality of scan lines, a plurality of channel lines, and a plurality of light emitting elements that are arranged in a matrix with a plurality of rows and a plurality of columns. For each of the rows of the light emitting elements, the light emitting elements are connected to a respective one of the scan lines. For each of the columns of the light emitting elements, the light emitting elements are connected to a respective one of the channel lines. The driving circuit includes a DLL, a signal processor, a scan driver and a channel driver. The DLL is for receiving a reference clock signal, and generates an internal global clock signal based on the reference clock signal. The signal processor is connected to the DLL for receiving the internal global clock signal therefrom, is for further receiving display data, and generates a scan control output and a channel control output based on the internal global clock signal and the display data. The scan driver is adapted to be connected to the scan lines, is further connected to the signal processor for receiving the scan control output therefrom, and drives the scan lines based on the scan control output. The channel driver is adapted to be connected to the channel lines, is further connected to the signal processor for receiving the channel control output therefrom, and provides a plurality of driving current signals respectively to the channel lines based on the channel control output.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
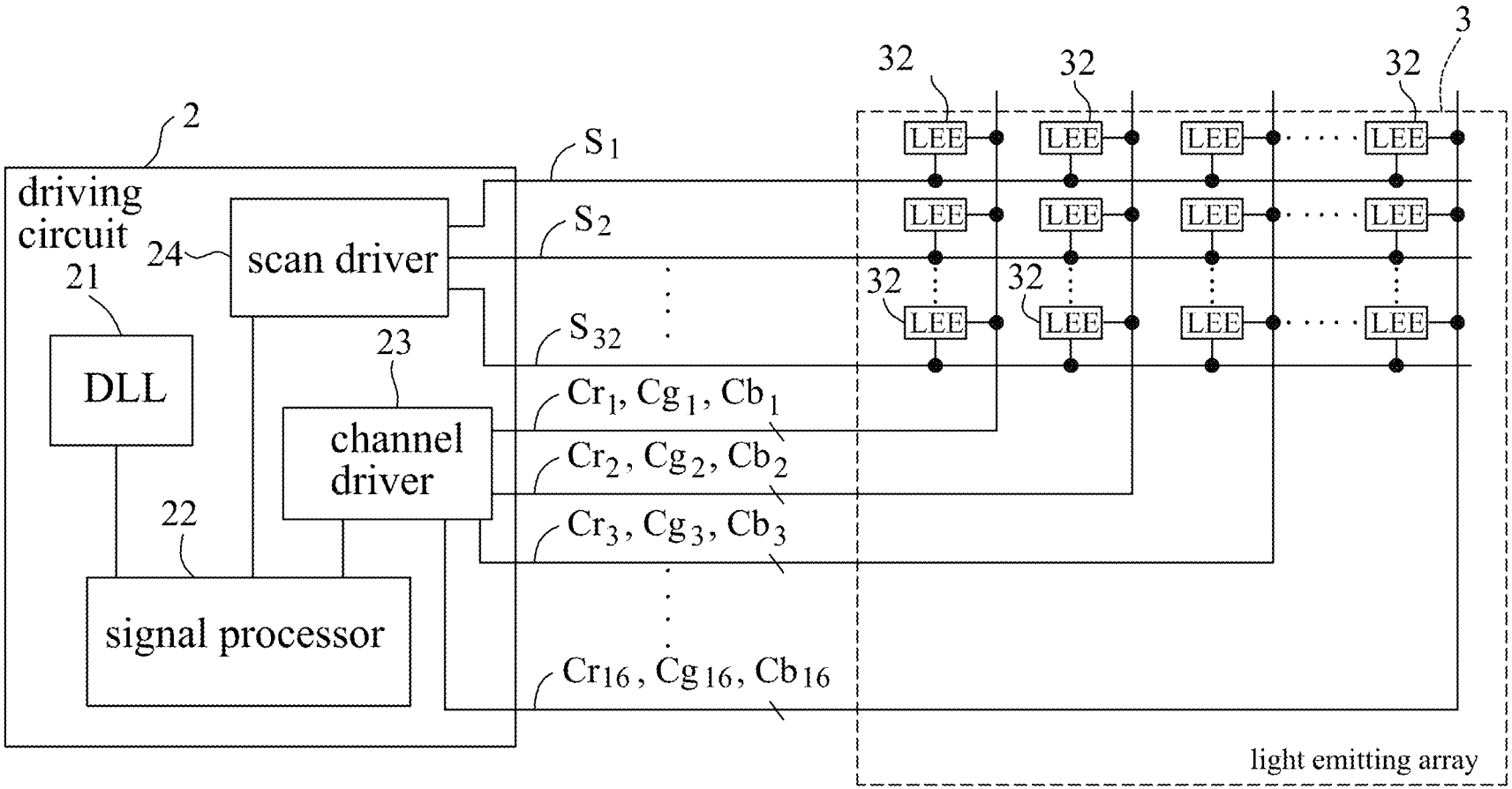
FIG. 1 is a block diagram illustrating a first embodiment of a display system according to the disclosure.

Before the disclosure is described in greater detail, it should be noted that where considered appropriate, reference numerals or terminal portions of reference numerals have been repeated among the figures to indicate corresponding or analogous elements, which may optionally have similar characteristics.

Referring to FIG. 1, a first embodiment of a display system according to the disclosure includes a light emitting array 3 and a driving circuit 2.

The light emitting array 3 includes a plurality of scan lines, a plurality of channel lines, and a plurality of light emitting elements (LEEs) 32 that are arranged in a matrix with a plurality of rows and a plurality of columns. For each of the rows of the light emitting elements 32, the light emitting elements 32 are connected to a respective one of the scan lines. For each of the columns of the light emitting elements 32, the light emitting elements 32 are connected to at least one of the channel lines.

Figure 2:
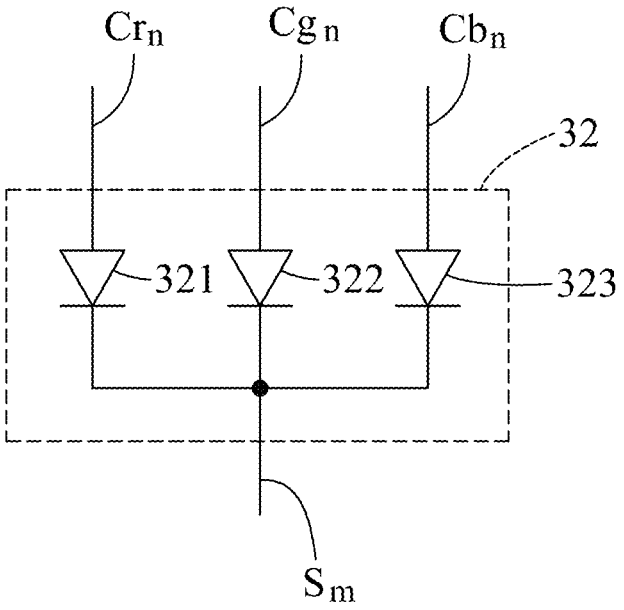
FIG. 2 is a circuit diagram illustrating a light emitting element of the first embodiment.

Referring to FIGS. 1 and 2, for illustration purposes, in this embodiment, there are thirty-two scan lines ($S_1$-$S_{32}$); there are forty-eight channel lines ($Cr_1$-$Cr_{16}$, $Cg_1$-$Cg_{16}$, $Cb_1$-$Cb_{16}$) that are divided into three groups, where the channel lines of the first group ($Cr_1$-$Cr_{16}$) are hereinafter referred to as the first channel lines, where the channel lines of the second group ($Cg_1$-$Cg_{16}$) are hereinafter referred to as the second channel lines, and where the channel lines of the third group ($Cb_1$-$Cb_{16}$) are hereinafter referred to as the third channel lines; there are thirty-two-by-sixteen light emitting elements 32 that are arranged in a matrix with thirty-two rows and sixteen columns; each of the light emitting elements 32 includes a red light emitting diode (LED) 321, a green LED 322 and a blue LED 323; for each of the columns of the light emitting elements 32, anodes (i.e., first terminals) of the red LEDs 321 of the light emitting elements 32 are connected to a respective one of the first channel lines ($Cr_1$-$Cr_{16}$), anodes (i.e., first terminals) of the green LEDs 322 of the light emitting elements 32 are connected to a respective one of the second channel lines ($Cg_1$-$Cg_{16}$), and anodes (i.e., first terminals) of the blue LEDs 323 of the light emitting elements 32 are connected to a respective one of the third channel lines ($Cb_1$-$Cb_6$); and for each of the rows of the light emitting elements 32, cathodes (i.e., second terminals) of the LEDs 321-323 of the light emitting elements 32 are connected to a respective one of the scan lines ($S_1$-$S_{32}$). In other words, the light emitting array 3 has a common cathode configuration in this embodiment.

Referring to FIG. 1, the driving circuit 2 includes a delay-locked loop (DLL) 21, a signal processor 22, a channel driver 23 and a scan driver 24. The DLL 21 generates an internal global clock signal based on at least a reference clock signal. The signal processor 22 is connected to the DLL 21, and generates a scan control output and a channel control output based on at least the internal global clock signal from the DLL 21 and display data. The channel driver 23 is connected to the first to third channel lines ($Cr_1$-$Cr_{16}$, $Cg_1$-$Cg_{16}$, $Cb_1$-$Cb_{16}$) and the signal processor 22, and provides sixteen first driving current signals, sixteen second driving current signals and sixteen third driving current signals respectively to the first to third channel lines ($Cr_1$-$Cr_{16}$, $Cg_1$-$Cg_{16}$, $Cb_1$-$Cb_{16}$) based on the channel control output from the signal processor 22. The scan driver 24 is connected to the scan lines ($S_1$-$S_{32}$) and the signal processor 22, and drives the scan lines ($S_1$-$S_{32}$) based on the scan control output from the signal processor 22.

Figure 3:
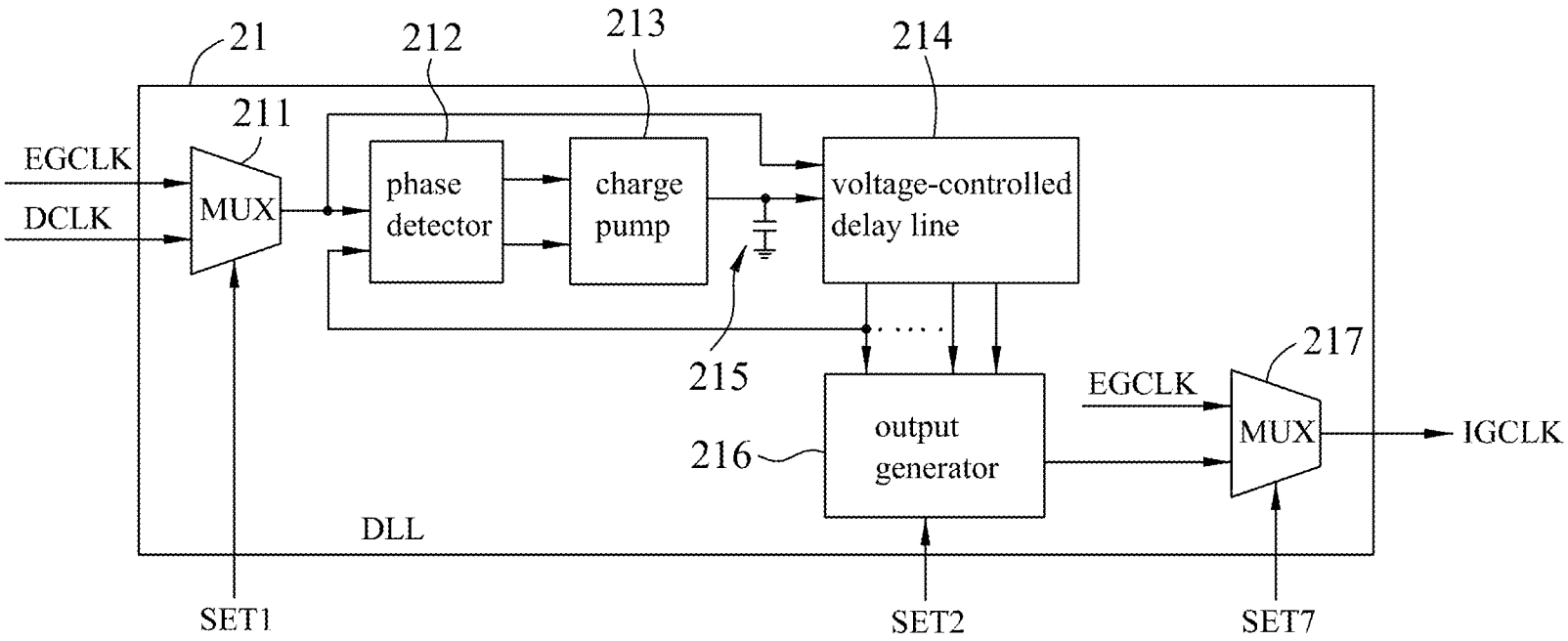
FIG. 3 is a block diagram illustrating a delay-locked loop of the first embodiment.

Referring to FIG. 3, in this embodiment, the DLL 21 includes two multiplexers (MUXs) 211, 217, a phase detector 212, a charge pump 213, a loop filter 215, a voltage-controlled delay line 214 and an output generator 216.

The multiplexer 211 is for receiving an external global clock signal (EGCLK) and a data clock signal (DCLK) that have different frequencies and that are asynchronous to each other, is for further receiving a first source control setting (SET1), and outputs one of the external global clock signal (EGCLK) and the data clock signal (DCLK) based on the first source control setting (SET1) to serve as the reference clock signal.

The phase detector 212 is connected to the multiplexer 211 for receiving the reference clock signal therefrom, is for further receiving a feedback clock signal, and generates a detection output related to a phase difference between the reference clock signal and the feedback clock signal.

The charge pump 213 is connected to the phase detector 212 for receiving the detection output therefrom, and generates a pump current signal based on the detection output.

The loop filter 215 is connected to the charge pump 213 for receiving the pump current signal therefrom, and generates a control voltage based on the pump current signal.

The voltage-controlled delay line 214 is connected to the loop filter 215 for receiving the control voltage therefrom, is further connected to the multiplexer 211 for receiving the reference clock signal therefrom, and is further connected to the phase detector 212. The voltage-controlled delay line 214 generates, based on the control voltage and the reference clock signal, a plurality of delayed clock signals with respective phase deviations from the reference clock signal that are different from each other and that are related to the control voltage. One of the delayed clock signals serves as the feedback clock signal for receipt by the phase detector 212.

The output generator 216 is connected to the voltage-controlled delay line 214 for receiving the delayed clock signals therefrom, is for further receiving a multiple control setting (SET2), and performs logical operations upon the delayed clock signals based on the multiple control setting (SET2) to generate an output clock signal with a frequency that is related to the multiple control setting (SET2) and that is a multiple of a frequency of the reference clock signal.

The multiplexer 217 is connected to the output generator 216 for receiving the output clock signal therefrom, is for further receiving the external global clock signal (EGCLK) and a second source control setting (SET7), and outputs one of the output clock signal and the external global clock signal (EGCLK) based on the second source control setting (SET7) to serve as the internal global clock signal (IGCLK).

In application, the first and second source control settings (SET1, SET7) and the multiple control setting (SET2) are determined based on an operation mode and frequency requirements of the display system of this embodiment. For example, when the display system is operated in a debug mode, the second source control setting (SET7) is set in such a way that the multiplexer 217 outputs the external global clock signal (EGCLK) to serve as the internal global clock signal (IGCLK); and when the display system is operated in a normal mode, the first and second source control settings (SET1, SET7) and the multiple control setting (SET2) are set in such a way that the multiplexer 211 outputs a selected one of the external global clock signal (EGCLK) and the data clock signal (DCLK) to serve as the reference clock signal, that the multiplexer 217 outputs the output clock signal to serve as the internal global clock signal (IGCLK), and that the frequency of the output clock signal (e.g., 80 MHz) is a multiple of the frequency of the selected one of the external global clock signal (EGCLK) and the data clock signal (DCLK), and meets the frequency requirements of the display system.

It should be noted that the DLL 21 may be a mixed-signal component or an all-digital component. Moreover, in another embodiment, the multiplexers 211, 217 may be omitted, so a predetermined one of the external global clock signal (EGCLK) and the data clock signal (DCLK) constantly serves as the reference clock signal, and the output clock signal constantly serves as the internal global clock signal (IGCLK).

Figure 4:
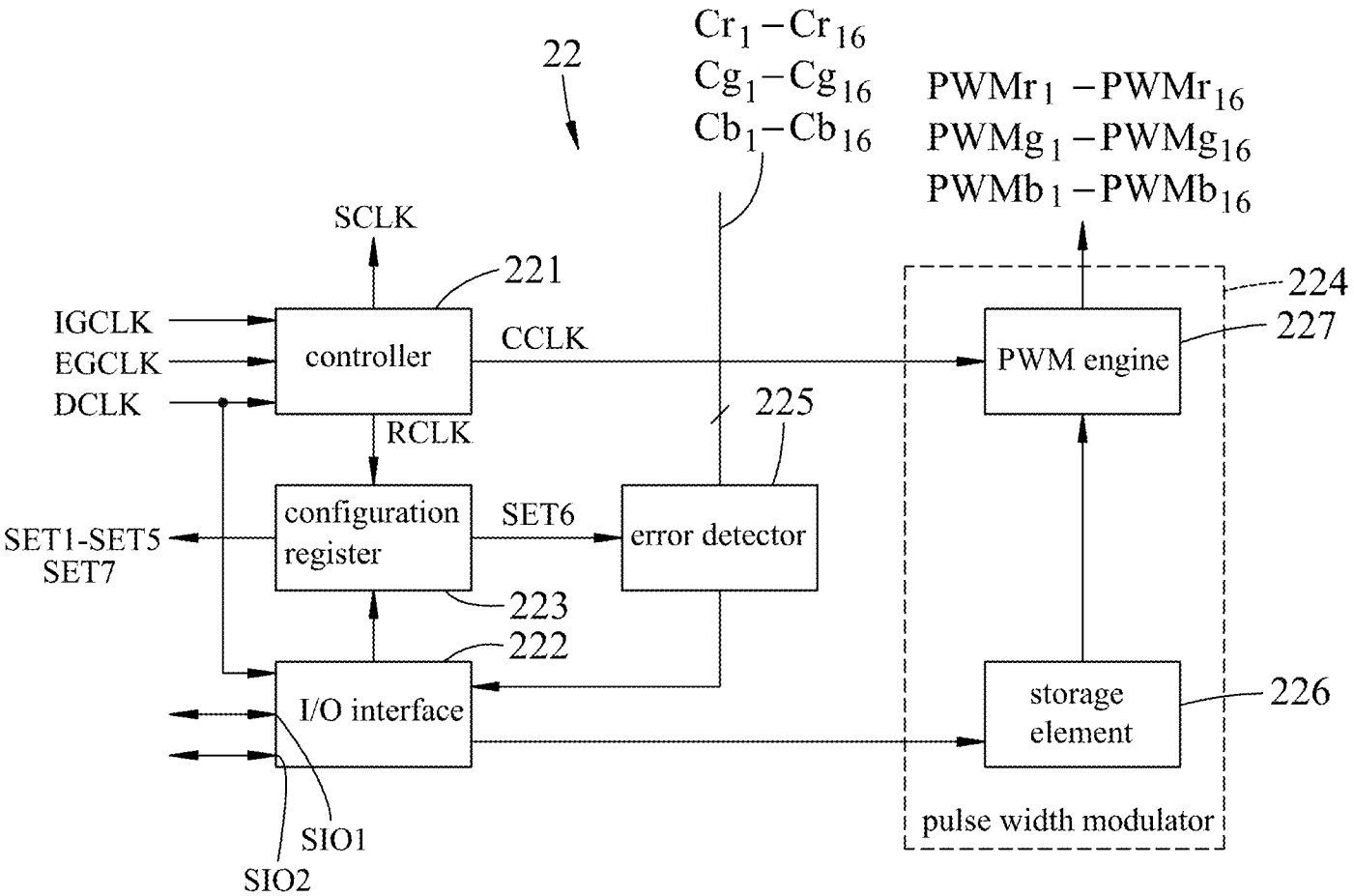
FIG. 4 is a block diagram illustrating a signal processor of the first embodiment.

Referring to FIG. 4, in this embodiment, the signal processor 22 includes a controller 221, an input/output (I/O) interface 222, a configuration register 223, a pulse width modulator 224 and an error detector 225.

The controller 221 is connected to the multiplexer 217 (see FIG. 3) for receiving the internal global clock signal (IGCLK) therefrom, and is for further receiving the external global clock signal (EGCLK) and the data clock signal (DCLK). The controller 221 generates a channel clock signal (CCLK) and a scan clock signal (SCLK) in synchrony with one of the internal global clock signal (IGCLK) and the external global clock signal (EGCLK), and generates a configuration clock signal (RCLK) in synchrony with the data clock signal (DCLK).

The I/O interface 222 includes a first serial I/O pin (SIO1), a second serial I/O pin (SIO2), and a 16-bit bi-directional shift register (not shown) that is connected between the first and second serial I/O pins (SIO1, SIO2). The I/O interface 222 is for receiving the data clock signal (DCLK), and is for further receiving, for example, from a central control system or the I/O interface 222 of a first additional one of the driving circuit 2, the display data and a plurality of control settings one bit at a time at the first serial I/O pin (SIO1) in synchrony with the data clock signal (DCLK). The I/O interface 222 outputs the display data and the control settings sixteen bits at a time, and further outputs the display data and the control settings one bit at a time at the second serial I/O pin (SIO2) for receipt by, for example, the I/O interface 222 of a second additional one of the driving circuit 2.

The configuration register 223 is connected to the controller 221 for receiving the configuration clock signal (RCLK) therefrom, and is further connected to the I/O interface 222 for receiving and storing the control settings therefrom sixteen bits at a time in synchrony with the configuration clock signal (RCLK).

In this embodiment, the configuration register 223 includes a plurality of 16-bit fields for storing the control settings; and the control settings include the first and second source control settings (SET1, SET7), the multiple control setting (SET2), a current gain control setting (SET3), a reference voltage control setting (SET4), a scan control setting (SET5) and an error detection control setting (SET6). The configuration register 223 is further connected to the multiplexers 211, 217 (see FIG. 3) for providing the first and second source control settings (SET1, SET7) respectively thereto, and is further connected to the output generator 216 (see FIG. 3) for providing the multiple control setting (SET2) thereto.

The pulse width modulator 224 includes a storage element 226 and a pulse width modulation (PWM) engine 227.

The storage element 226 is connected to the I/O interface 222 for receiving and storing the display data therefrom sixteen bits at a time. The storage element 226 may be a static random access memory (SRAM), a dynamic random access memory (DRAM), a register file that includes a plurality of D flip-flops, or the like. In this embodiment, the display data contains thirty-two-by-forty-eight 16-bit grey scale values that respectively correspond to the LEDs 321-323 (see FIG. 2) of the light emitting array 3 (see FIG. 1); and the storage element 226 is a ping-pong SRAM with a capacity of 48K bits, and stores all of these grey scale values.

Figure 5:
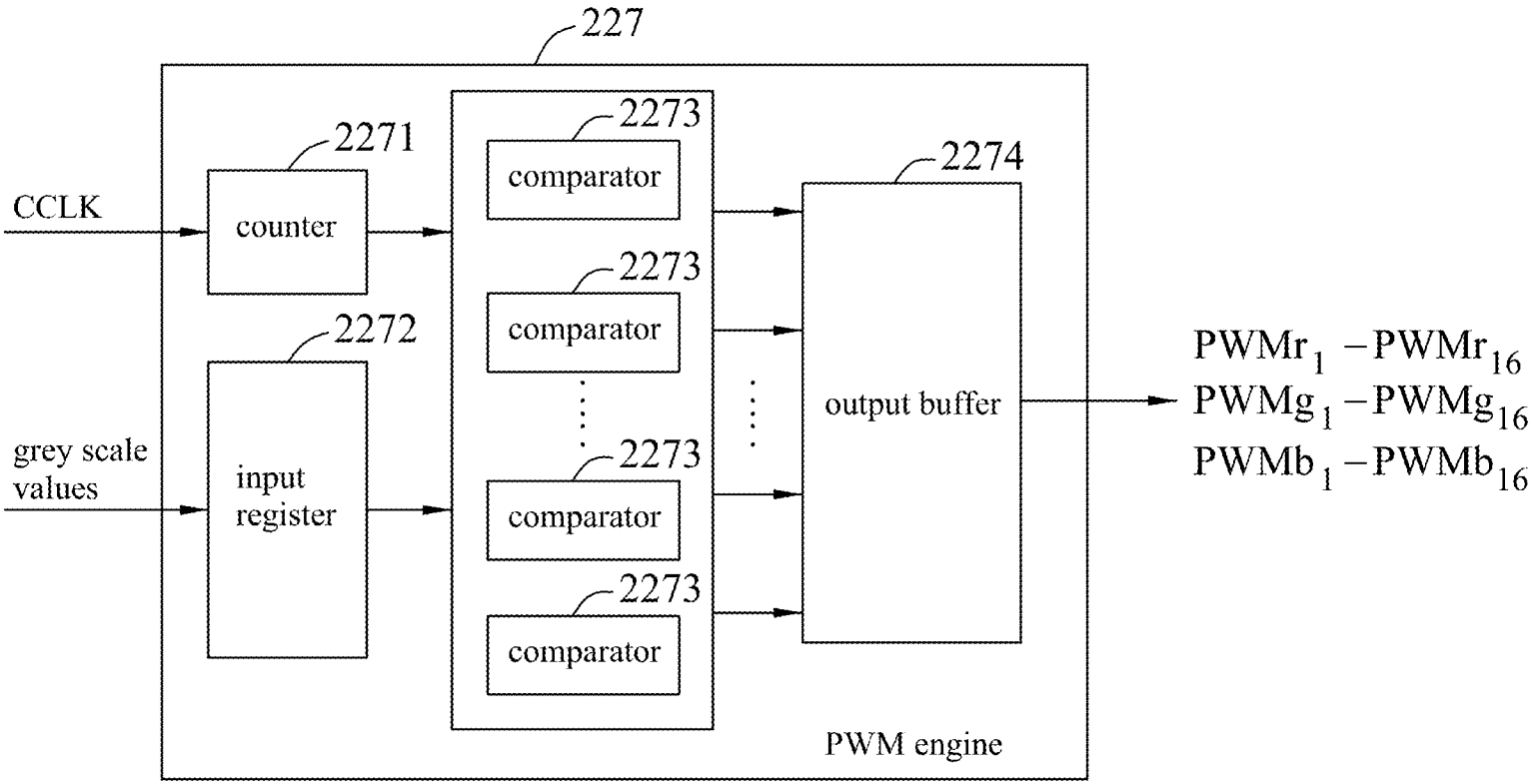
FIG. 5 is a block diagram illustrating a pulse width modulation engine of the signal processor of the first embodiment.

Referring to FIGS. 1, 4 and 5, the PWM engine 227 includes a 16-bit counter 2271, an input register 2272 with a capacity of forty-eight-by-sixteen bits, forty-eight 16-bit comparators 2273 and an output buffer 2274. The counter 2271 is connected to the controller 221 for receiving the channel clock signal (CCLK) therefrom, and increments a counting value in synchrony with the channel clock signal (CCLK). The input register 2272 is connected to the storage element 226 for receiving and storing forty-eight of the grey scale values that respectively correspond to the LEDs 321-323 (see FIG. 2) of the light emitting elements 32 in a predetermined one of the rows. Each of the comparators 2273 is connected to the counter 2271 for receiving the counting value therefrom, is further connected to the input register 2272 for receiving a respective one of the grey scale values stored therein, and compares the counting value and the received grey scale value to generate a comparison signal. The output buffer 2274 is connected to the comparators 2273 for receiving the comparison signals therefrom, and buffers the comparison signals to generate sixteen first PWM signals ($PWMr_1$-$PWMr_{16}$), sixteen second PWM signals ($PWMg_1$-$PWMg_{16}$) and sixteen third PWM signals ($PWMb_1$-$PWMb_{16}$). The first PWM signals ($PWMr_1$-$PWMr_{16}$) respectively correspond to the first channel lines ($Cr_1$-$Cr_{16}$), and each has a pulse width related to the grey scale value that corresponds to a respective one of the red LEDs 321 (see FIG. 2) of the light emitting elements 32 in the predetermined one of the rows. The second PWM signals ($PWMg_1$-$PWMg_{16}$) respectively correspond to the second channel lines ($Cg_1$-$Cg_{16}$), and each has a pulse width related to the grey scale value that corresponds to a respective one of the green LEDs 322 (see FIG. 2) of the light emitting elements 32 in the predetermined one of the rows. The third PWM signals ($PWMb_1$-$PWMb_{16}$) respectively correspond to the third channel lines ($Cb_1$-$Cb_{16}$), and each has a pulse width related to the grey scale value that corresponds to a respective one of the blue LEDs 323 (see FIG. 2) of the light emitting elements 32 in the predetermined one of the rows.

The channel control output includes the first to third PWM signals ($PWMr_1$-$PWMr_{16}$, $PWMg_1$-$PWMg_{16}$, $PWMb_1$-$PWMb_{16}$) that are generated by the PWM engine 227, and the current gain control setting (SET3) and the reference voltage control setting (SET4) that are stored in the configuration register 223. The scan control output includes the scan clock signal (SCLK) that is generated by the controller 221, and the scan control setting (SET5) that is stored in the configuration register 223.

Figure 6:
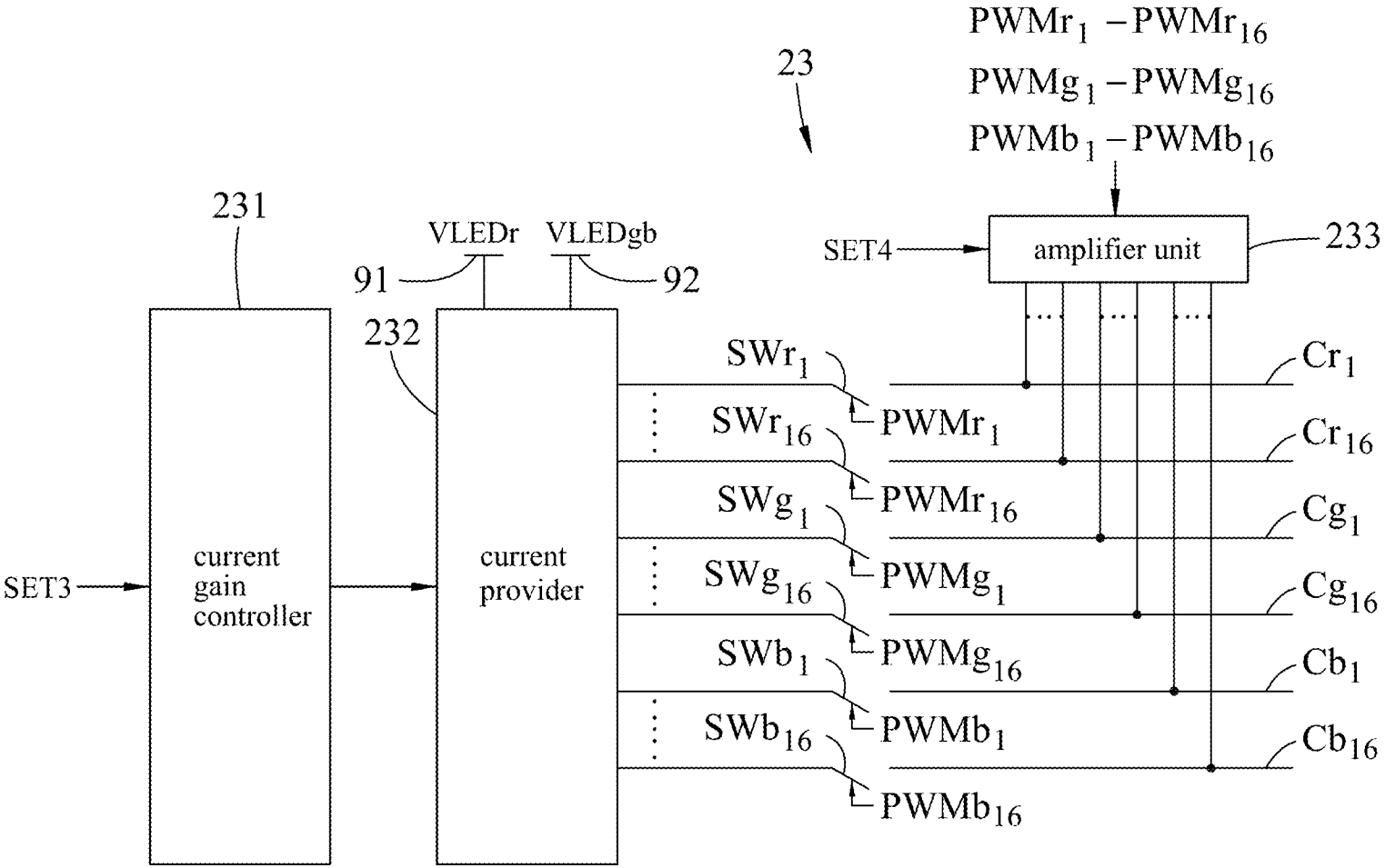
FIG. 6 is a circuit block diagram illustrating a channel driver of the first embodiment.

Referring to FIG. 6, in this embodiment, the channel driver 23 includes a current gain controller 231, a current provider 232, sixteen first channel switches ($SWr_1$-$SWr_{16}$), sixteen second channel switches ($SWg_1$-$SWg_6$), sixteen third channel switches ($SWb_1$-$SWb_{16}$) and an amplifier unit 233.

The current gain controller 231 is connected to the configuration register 223 (see FIG. 4) for receiving the current gain control setting (SET3) therefrom, and generates a first current gain control signal, a second current gain control signal and a third current gain control signal based on the current gain control setting (SET3).

The current provider 232 is connected to the current gain controller 231 for receiving the first to third current gain control signals therefrom, is adapted to be further connected to a first power rail 91 for receiving therefrom a first supply voltage (VLEDr) with a magnitude that falls within a range of 2.4V to 4.5V, and is adapted to be further connected to a second power rail 92 for receiving therefrom a second supply voltage (VLEDgb) with a magnitude that falls within a range of 3.2V to 4.5V. The current provider 232 provides sixteen first driving currents that respectively correspond to the first channel lines ($Cr_1$-$Cr_{16}$), sixteen second driving currents that respectively correspond to the second channel lines ($Cg_1$-$Cg_{16}$), and sixteen third driving currents that respectively correspond to the third channel lines ($Cg_1$-$Cg_{16}$). The first driving currents are sourced from the first power rail 91. The second and third driving currents are sourced from the second power rail 92. The current provider 232 further adjusts magnitudes of the first driving currents based on the first current gain control signal, adjusts magnitudes of the second driving currents based on the second current gain control signal, and adjusts magnitudes of the third driving currents based on the third current gain control signal.

The first channel switches ($SWr_1$-$SWr_{16}$) respectively correspond to the first channel lines ($Cr_1$-$Cr_{16}$). The second channel switches ($SWg_1$-$SWg_{16}$) respectively correspond to the second channel lines ($Cg_1$-$Cg_{16}$). The third channel switches ($SWb_1$-$SWb_{16}$) respectively correspond to the third channel lines ($Cb_1$-$Cb_{16}$). Each of the first to third channel switches ($SWr_1$-$SWr_{16}$, $SWg_1$-$SWg_{16}$, $SWb_1$-$SWb_{16}$) has a first terminal that is connected to the current provider 232, a second terminal that is connected to a corresponding one of the first to third channel lines ($Cr_1$-$Cr_{16}$, $Cg_1$-$Cg_{16}$, $Cb_1$-$Cb_6$), and a control terminal that is connected to the output buffer 2274 (see FIG. 5) for receiving therefrom one of the first to third PWM signals ($PWMr_1$-$PWMr_{16}$, $PWMg_1$-$PWMg_{16}$, $PWMb_1$-$PWMb_{16}$) which corresponds to the corresponding one of the first to third channel lines ($Cr_1$-$Cr_{16}$, $Cg_1$-$Cg_{16}$, $Cb_1$-$Cb_{16}$). Each of the first to third channel switches ($SWr_1$-$SWr_{16}$, $SWg_1$-$SWg_{16}$, $SWb_1$-$SWb_{16}$) permits one of the first to third driving currents, which corresponds to the corresponding one of the first to third channel lines ($Cr_1$-$Cr_{16}$, $Cg_1$-$Cg_{16}$, $Cb_1$-$Cb_{16}$), to flow through the channel switch when the channel switch conducts.

The first driving current signals are respectively provided at the second terminals of the first channel switches ($SWr_1$-$SWr_{16}$). The second driving current signals are respectively provided at the second terminals of the second channel switches ($SWg_1$-$SWg_{16}$) The third driving current signals are respectively provided at the second terminals of the third channel switches ($SWb_1$-$SWb_{16}$). A magnitude of each of the first to third driving current signals is equal to the magnitude of a corresponding one of the first to third driving currents when a corresponding one of the first to third channel switches ($SWr_1$-$SWr_{16}$, $SWg_1$-$SWg_{16}$, $SWb_1$-$SWb_{16}$) conducts, and is zero otherwise.

The amplifier unit 233 is connected to the first to third channel lines ($Cr_1$-$Cr_{16}$, $Cg_1$-$Cg_{16}$, $Cb_1$-$Cb_{16}$), is further connected to the configuration register 223 (see FIG. 4) for receiving the reference voltage control setting (SET4) therefrom, and is further connected to the output buffer 2274 (see FIG. 5) for receiving the first to third PWM signals ($PWMr_1$-$PWMr_{16}$, $PWMg_1$-$PWMg_{16}$, $PWMb_1$-$PWMb_{16}$) therefrom. For each of the first to third channel lines ($Cr_1$-$Cr_{16}$, $Cg_1$-$Cg_{16}$, $Cb_1$-$Cb_{16}$), the amplifier unit 233 adjusts a magnitude of a voltage at the channel line to a corresponding reference voltage value when one of the first to third PWM signals ($PWMr_1$-$PWMr_{16}$, $PWMg_1$-$PWMg_{16}$, $PWMb_1$-$PWMb_{16}$) that corresponds to the channel line causes one of the first to third channel switches ($SWr_1$-$SWr_{16}$, $SWg_1$-$SWg_{16}$, $SWb_1$-$SWb_{16}$) that corresponds to the channel line to not conduct. For example, the magnitude of the voltage at each of the first channel lines ($Cr_1$-$Cr_{16}$) is adjusted to a first reference voltage value, the magnitude of the voltage at each of the second channel lines ($Cg_1$-$Cg_{16}$) is adjusted to a second reference voltage value, and the magnitude of the voltage at each of the third channel lines ($Cb_1$-$Cb_{16}$) is adjusted to a third reference voltage value. As a consequence, non-ideal effects such as lower ghosting, dark lines and coupling can be eliminated.

Figure 7:
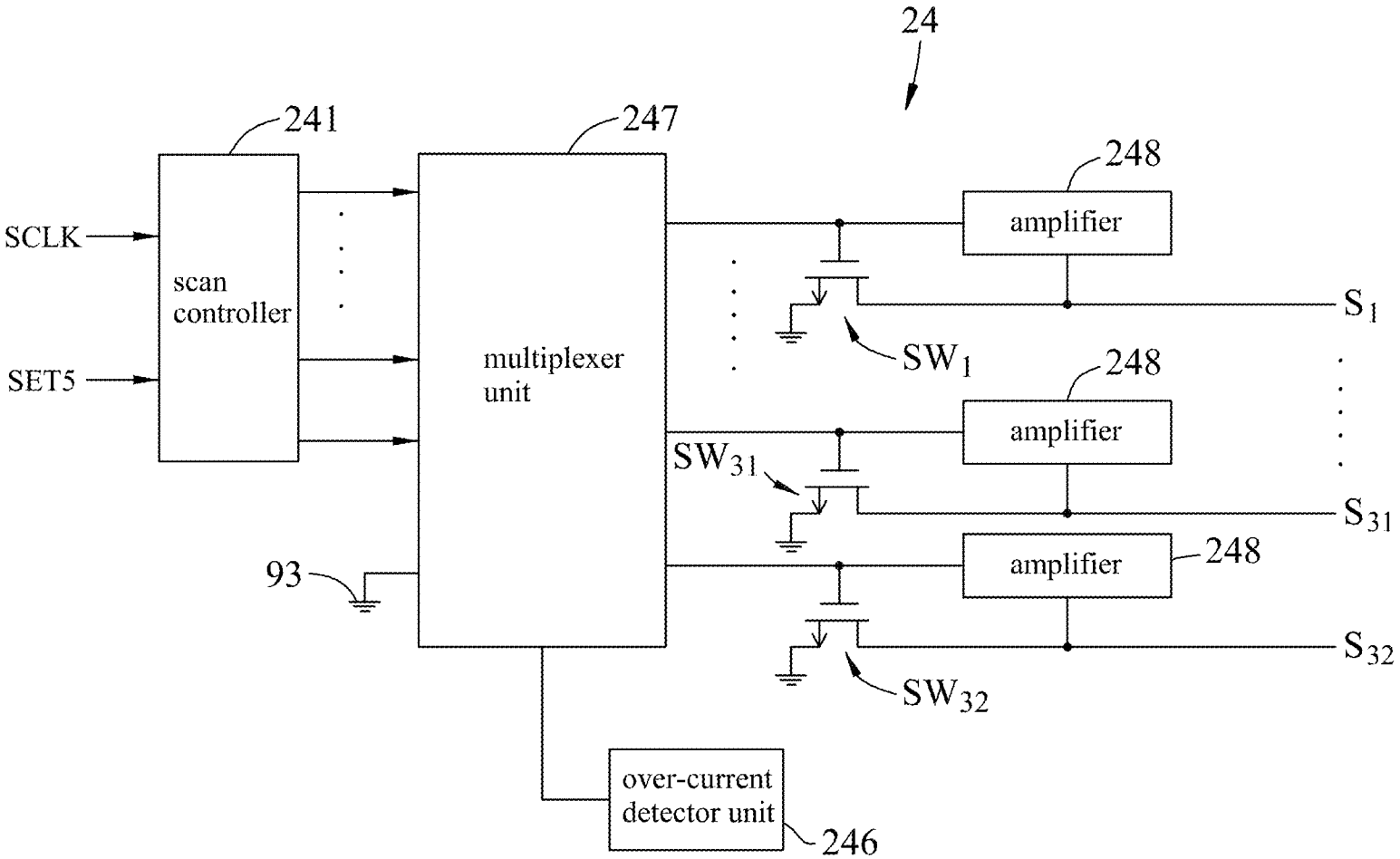
FIG. 7 is a circuit block diagram illustrating a scan driver of the first embodiment.

Referring to FIG. 7, in this embodiment, the scan driver 24 includes a scan controller 241, a multiplexer unit 247, thirty-two scan switches ($SW_1$-$SW_{32}$) thirty-two amplifiers 248 and an over-current detector unit 246.

The scan controller 241 is connected to the controller 221 (see FIG. 4) for receiving the scan clock signal (SCLK) therefrom, and is further connected to the configuration register 223 (see FIG. 4) for receiving the scan control setting (SET5) therefrom. The scan controller 241 generates thirty-two scan control signals, which respectively correspond to the scan lines ($S_1$-$S_{32}$), based on the scan clock signal (SCLK) and the scan control setting (SET5) in such a way that at least some of the scan control signals transition between two different logical states in synchrony with the scan clock signal (SCLK) and that a number of the at least some of the scan control signals is related to the scan control setting (SET5).

The multiplexer unit 247 is connected to the scan controller 241 for receiving the scan control signals therefrom, is adapted to be further connected to a third power rail 93 for receiving a ground voltage therefrom, is for further receiving thirty-two indication signals that respectively correspond to the scan lines ($S_1$-$S_{32}$), and generates thirty-two switch control signals that respectively correspond to the scan lines ($S_1$-$S_{32}$). For each of the scan lines ($S_1$-$S_{32}$), the multiplexer unit 247 outputs one of the scan control signal corresponding to the scan line and the ground voltage based on the indication signal corresponding to the scan line to serve as the switch control signal corresponding to the scan line.

Each of the scan switches ($SW_1$-$SW_{32}$) (e.g., an N-type power semiconductor transistor) has a first terminal (e.g., a drain terminal) that is connected to a respective one of the scan lines ($S_1$-$S_{32}$), a second terminal (e.g., a source terminal) that is adapted to be connected to the third power rail 93 for receiving the ground voltage therefrom, and a control terminal (e.g., a gate terminal) that is connected to the multiplexer unit 247 for receiving therefrom one of the switch control signals which corresponds to the respective one of the scan lines ($S_1$-$S_{32}$).

Each of the amplifiers 248 is connected to a respective one of the scan lines ($S_1$-$S_{32}$) r, and is further connected to the multiplexer unit 247 for receiving therefrom one of the switch control signals that corresponds to the respective one of the scan lines ($S_1$-$S_{32}$). Each of the amplifiers 248 adjusts a magnitude of a voltage at the respective one of the scan lines ($S_1$-$S_{32}$) to a predetermined reference voltage value when the one of the switch control signals causes one of the scan switches ($SW_1$-$SW_{32}$) that is connected to the respective one of the scan lines ($S_1$-$S_{32}$) to not conduct. As a consequence, upper ghosting can be eliminated.

Figure 8:
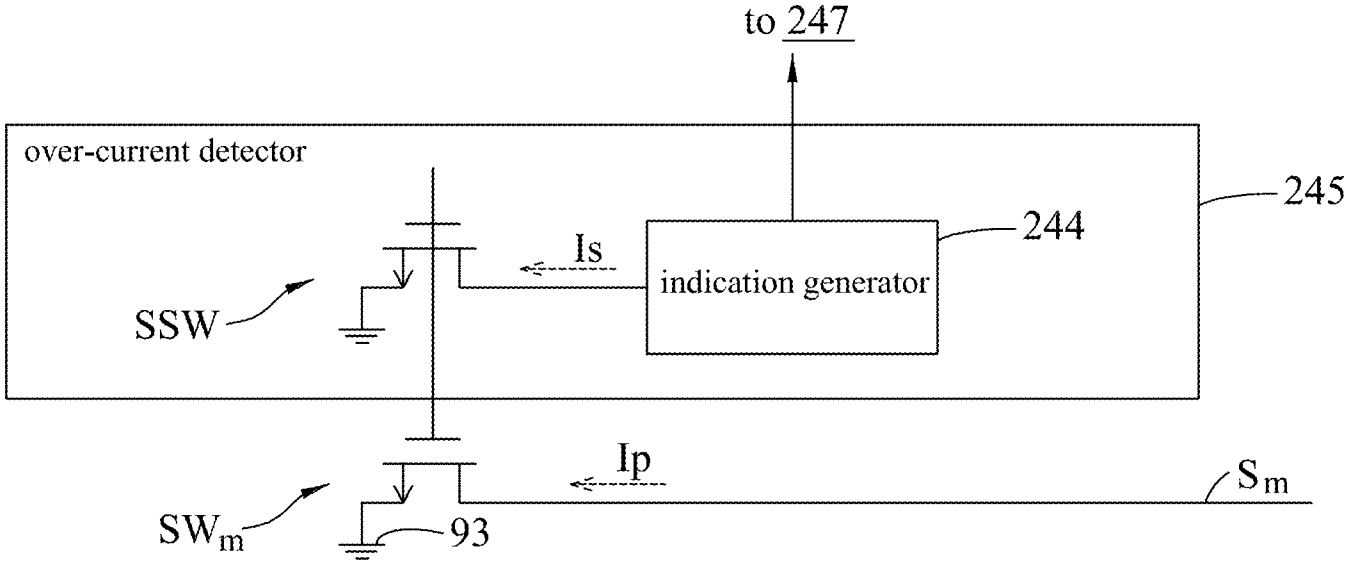
FIG. 8 is a circuit block diagram illustrating an over-current detector of the scan driver of the first embodiment.

Referring to FIGS. 7 and 8, the over-current detector unit 246 includes thirty-two over-current detectors 245. Each of the over-current detectors 245 includes a detector switch (SSW) and an indication generator 244. The detector switch (SSW) (e.g., an N-type power semiconductor transistor) has a first terminal (e.g., a drain terminal), a second terminal (e.g., a source terminal) that is connected to the second terminal of a respective one of the scan switches ($SW_1$-

$SW_{32}$), and a control terminal (e.g., a gate terminal) that is connected to the control terminal of the respective one of the scan switches ($SW_1$-$SW_{32}$). The detector switch (SSW) has a size that is about one-thousandth of a size of the respective one of the scan switches ($SW_1$-$SW_{32}$), so a current (Is) flowing therethrough has a magnitude that is about one-thousandth of a magnitude of a current (Ip) flowing through the respective one of the scan switches ($SW_1$-$SW_{32}$). The indication generator 244 is connected to the first terminal of the detector switch (SSW), is further connected to the multiplexer unit 247, and generates, based on the current (Is) for receipt by the multiplexer unit 247, one of the indication signals that corresponds to one of the scan lines ($S_1$-$S_{32}$) which is connected to the respective one of the scan switches ($SW_1$-$SW_{32}$). The one of the indication signals indicates whether the magnitude of the current (Ip) is greater than a predetermined rated current value. For each of the scan lines ($S_1$-$S_{32}$), the multiplexer unit 247 outputs the ground voltage to serve as the switch control signal corresponding to the scan line when the the indication signal corresponding to the scan line indicates that the magnitude of the current (Ip) is greater than the predetermined rated current value, and outputs the scan control signal corresponding to the scan line to serve as the switch control signal corresponding to the scan line otherwise. As a consequence, each of the scan switches ($SW_1$-$SW_{32}$) is forced to not conduct when it is detected to be undergoing current overflow, thereby achieving over-current protection.

Referring back to FIG. 4, the error detector 225 is connected to the configuration register 223 for receiving the error detection control setting (SET6) therefrom, and is further connected to the first to third channel lines ($Cr_1$-$Cr_{16}$, $Cg_1$-$Cg_{16}$, $Cb_1$-$Cb_{16}$) and the I/O interface 222. The error detector 225 generates a first threshold voltage, a second threshold voltage and a third threshold voltage based on the error detection control setting (SET6). The first to third threshold voltages may have the same magnitude or different magnitudes. For each of the first channel lines ($Cr_1$-$Cr_{16}$), the error detector 225 compares the voltage at the first channel line with the first threshold voltage to generate a respective first comparison signal that is at a logic "1" level when the voltage at the first channel line is greater than the first threshold voltage in magnitude, and that is at a logic "0" level otherwise. For each of the second channel lines ($Cg_1$-$Cg_{16}$), the error detector 225 compares the voltage at the second channel line with the second threshold voltage to generate a respective second comparison signal that is at the logic "1" level when the voltage at the second channel line is greater than the second threshold voltage in magnitude, and that is at the logic "0" level otherwise. For each of the third channel lines ($Cb_1$-$Cb_{16}$), the error detector 225 compares the voltage at the third channel line with the third threshold voltage to generate a respective third comparison signal that is at the logic "1" level when the voltage at the third channel line is greater than the third threshold voltage in magnitude, and that is at the logic "0" level otherwise. When the error detection control setting (SET6) is set to detect LED open circuit failures, the logic "1" level indicates that an LED open circuit failure is detected, and the logic "0" level indicates that an LED open circuit failure is not detected. When the error detection control setting (SET6) is set to detect LED short circuit failures, the logic "1" level indicates that an LED short circuit failure is not detected, and the logic "0" level indicates that an LED short circuit failure is detected. The error detector 225 outputs the first to third comparison signals one bit at a time for receipt by the I/O interface 222, and the I/O interface 222 outputs the first to third comparison signals from the error detector 225 one bit at a time at the first serial I/O pin (SIO1) for receipt by the central control system or the I/O interface 222 of the first additional one of the driving circuit 2. The I/O interface 222 is for further receiving the first to third comparison signals from the I/O interface 222 of the second additional one of the driving circuit 2 one bit at a time at the second serial I/O pin (SIO2), and outputs the first to third comparison signals from the I/O interface 222 of the second additional one of the driving circuit 2 one bit at a time at the first serial I/O pin (SIO1) for receipt by the central control system or the I/O interface 222 of the first additional one of the driving circuit 2.

Referring to FIGS. 1, 4 and 6, it should be noted that, in a modification of the first embodiment, the driving circuit 2 may further include a power saving unit (not shown); the configuration register 223 may further store a grey scale control setting that contains a grey scale threshold; the power saving unit may be connected to the configuration register 223 for receiving the grey scale control setting therefrom, may be further connected to the input register 2272 (see FIG. 5) for receiving the grey scale values stored therein, and may be further connected to the channel driver 23; when all of the received grey scale values are zero, the power saving unit may disable all analog circuits of the current gain controller 231 and all analog circuits of the current provider 232 to reduce power consumption; and when at least one of the received grey scale values is non-zero, for each of the first to third channel lines ($Cr_1$-$Cr_{16}$, $Cg_1$-$Cg_{16}$, $Cb_1$-$Cb_{16}$), the power saving unit may disable some of the analog circuits of the current gain controller 231 and the current provider 232 that are related to the channel line after one of the first to third channel switches ($SWr_1$-$SWr_{16}$, $SWg_1$-$SWg_{16}$, $SWb_1$-$SWb_{16}$) that is connected to the channel line transitions to non-conduction in a case where one of the received grey scale values that corresponds to the channel line is smaller than the grey scale threshold, so as to reduce power consumption.

Figure 9:
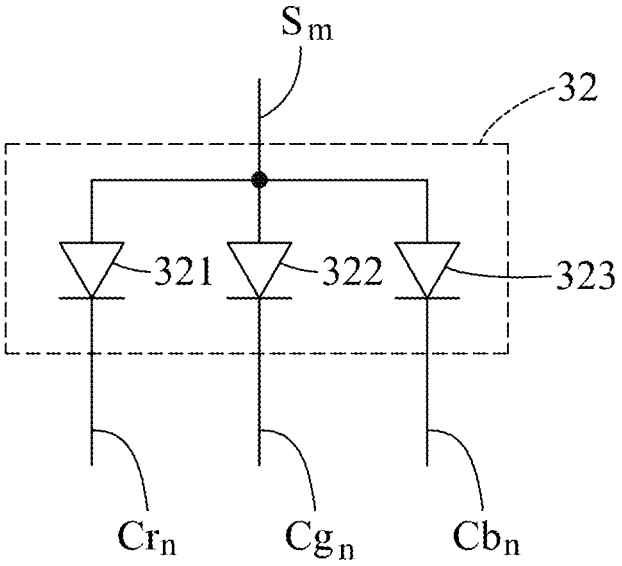
FIG. 9 is a circuit diagram illustrating a light emitting element of a second embodiment of the display system according to the disclosure.

Referring to FIGS. 1 and 9, a second embodiment of the display system according to the disclosure is similar to the first embodiment, but is different in what are described below.

In the second embodiment, for each of the columns of the light emitting elements 32, the cathodes (i.e., the first terminal) of the red LEDs 321 of the light emitting elements 32 are connected to a respective one of the first channel lines ($Cr_1$-$Cr_{16}$), the cathodes (i.e., the first terminal) of the green LEDs 322 of the light emitting elements 32 are connected to a respective one of the second channel lines ($Cg_1$-$Cg_{16}$), and the cathodes (i.e., the first terminal) of the blue LEDs 323 of the light emitting elements 32 are connected to a respective one of the third channel lines ($Cb_1$-$Cb_{16}$) For each of the rows of the light emitting elements 32, the anodes (i.e., the second terminal) of the LEDs 321-323 of the light emitting elements 32 are connected to the respective one of the scan lines ($S_1$-$S_{32}$). In other words, the LED array 3 has a common anode configuration in this embodiment.

Figure 10:
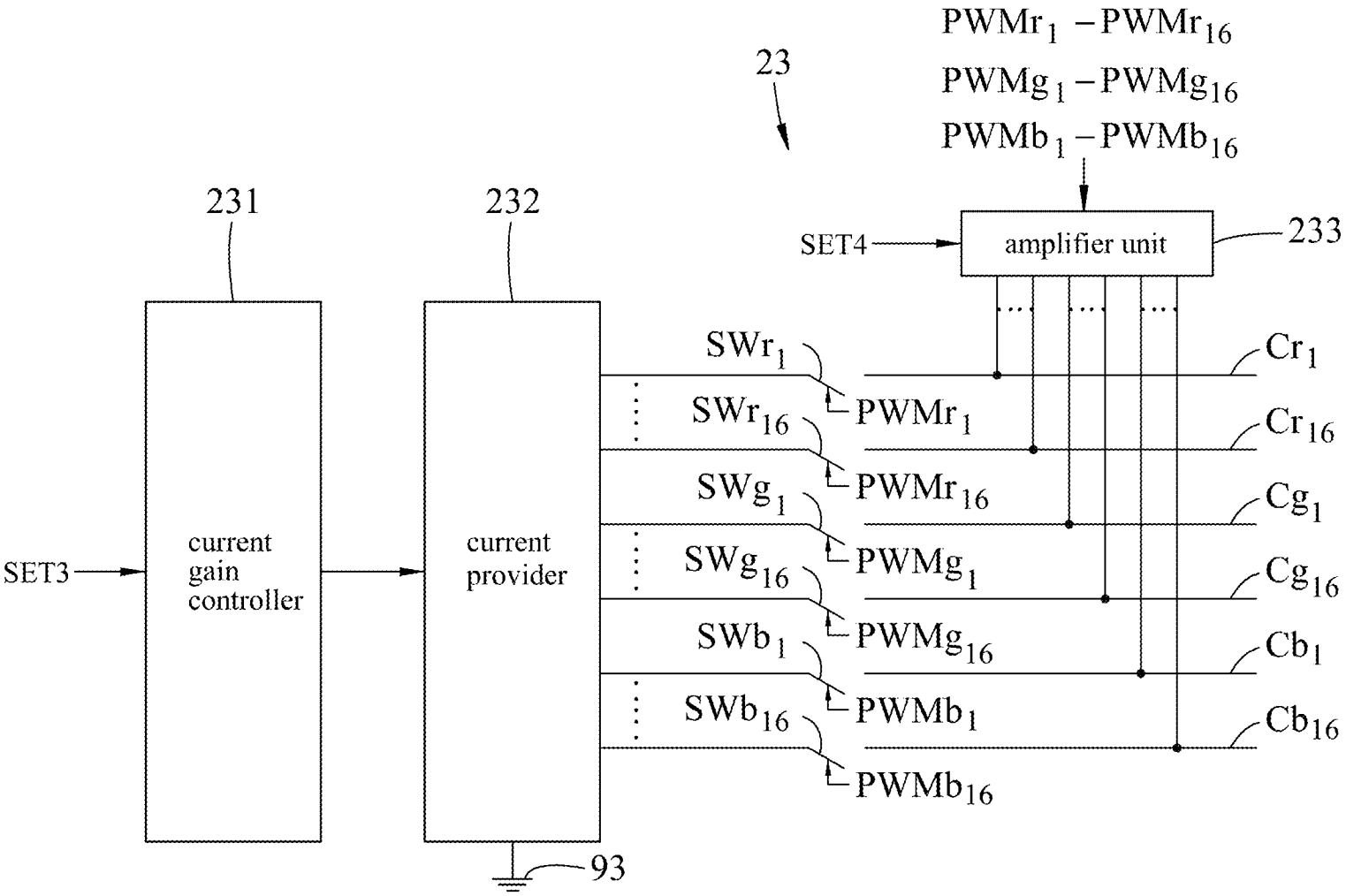
FIG. 10 is a circuit block diagram illustrating a channel driver of the second embodiment.

Referring to FIG. 10, the current provider 232 is adapted to be connected to the third power rail 93 for receiving the ground voltage therefrom, instead of being connected to the first and second power rails 91, 92 (see FIG. 6) for receiving the first and second supply voltages (VLEDr, VLEDgb) (see FIG. 6) respectively therefrom; and the first to third driving currents are sunk to the third power rail 93.

Figure 11:
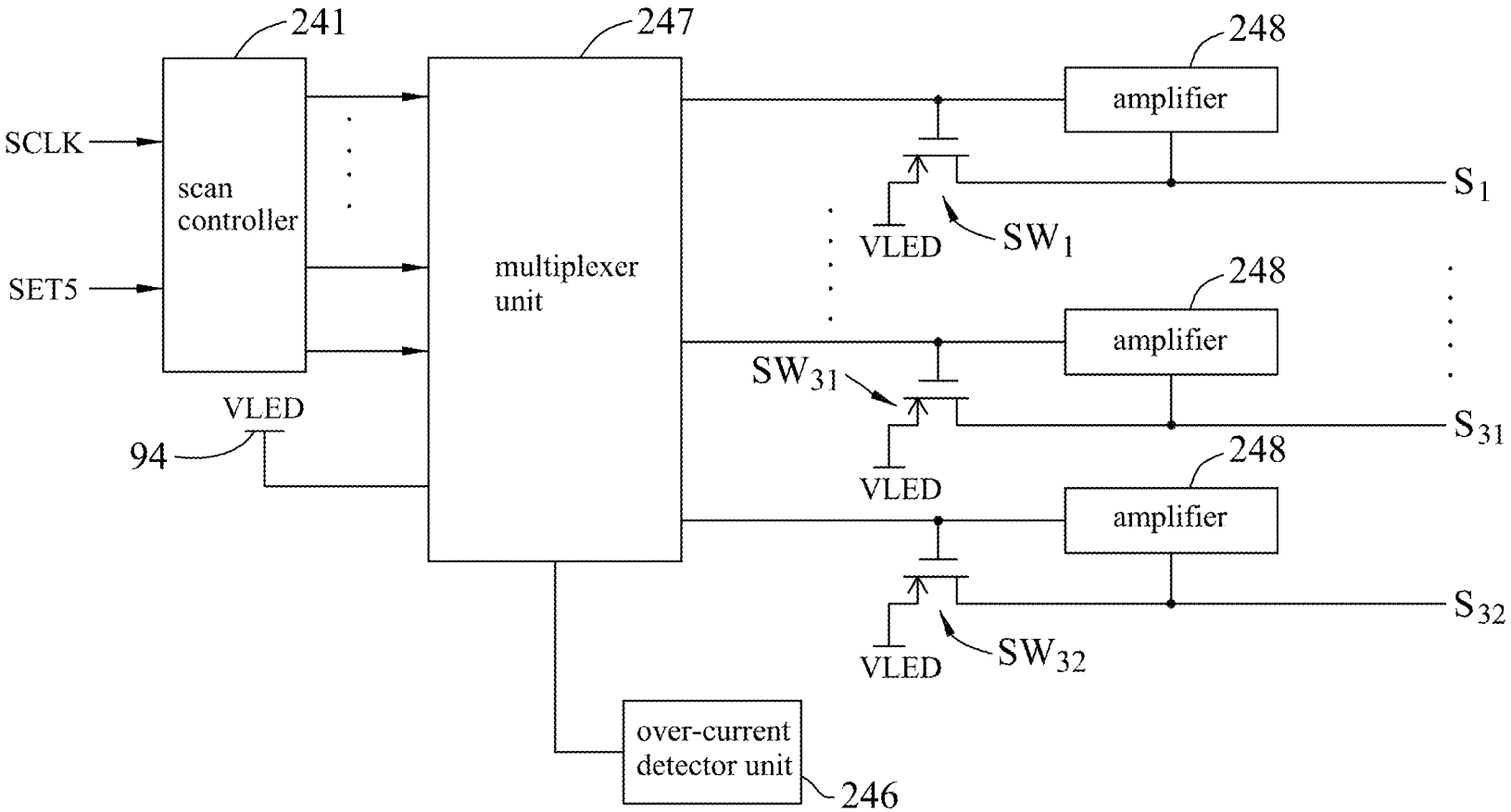
FIG. 11 is a circuit block diagram illustrating a scan driver of the second embodiment.
Figure 12:
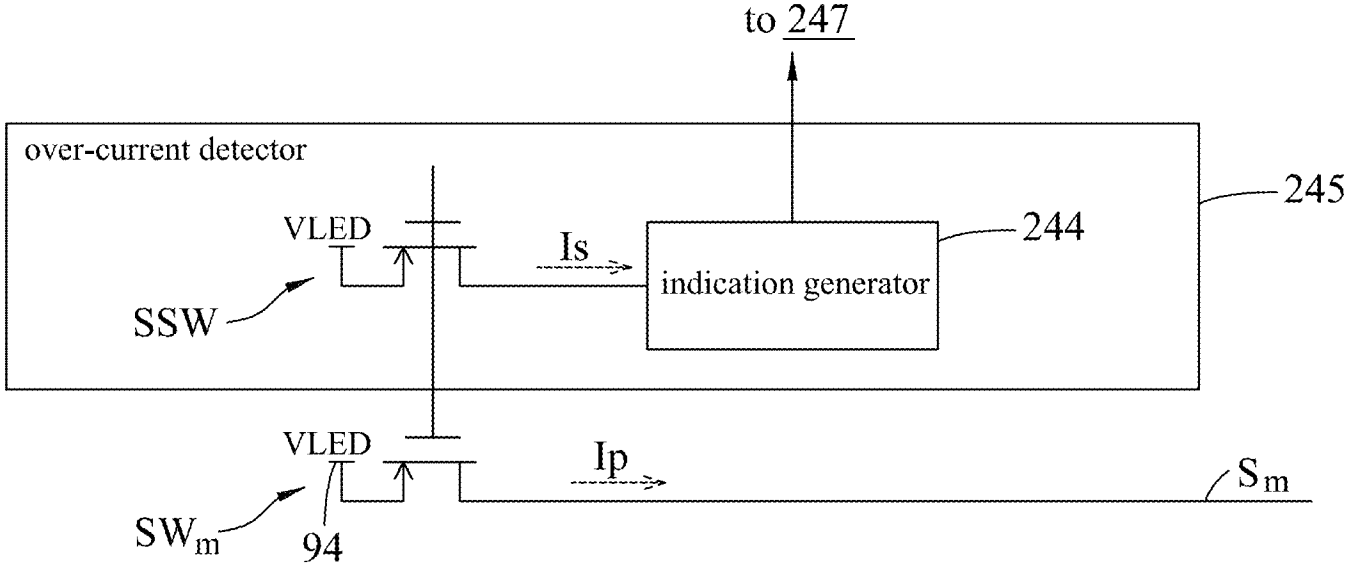
FIG. 12 is a circuit block diagram illustrating an over-current detector of the scan driver of the second embodiment.

Referring to FIGS. 11 and 12, each of the scan switches ($SW_1$-$SW_{32}$) and the detector switches (SSW) of the over-current detectors 245 is a P-type power semiconductor transistor; and the multiplexer unit 247 and the second terminals of the scan switches ($SW_1$-$SW_{32}$) are adapted to be connected to a fourth power rail 94 for receiving therefrom a third supply voltage (VLED) with a magnitude that falls within a range of 3.2V to 5V, instead of being connected to the third power rail 93 (see FIG. 7) for receiving the ground voltage therefrom.

Referring back to FIG. 1, in view of the above, for each of the aforesaid embodiments, in comparison to a phase-locked loop (PLL), the DLL 21 occupies a smaller area and uses fewer analog circuits, so the driving circuit 2 can have a small area, and does not need to be dramatically adjusted in circuit parameters and/or circuit architecture when a semiconductor process for fabricating the driving circuit 2 is changed.

In addition, according to the description above, design engineers can easily modify the driving circuit 2 of the first embodiment, which is used to drive the light emitting array 3 with the common cathode configuration, into the driving circuit 2 of the second embodiment, which is used to drive the light emitting array 3 with the common anode configuration, thereby saving human resources and time.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what are considered the exemplary embodiments, it is understood that the disclosure is not limited to the disclosed embodiments but is intended to cover various arrangements included within the spirit and scope of the broadest interpretation so as to encompass all such modifications and equivalent arrangements.

What is claimed is:

1. A display system comprising:

a light emitting array including a plurality of scan lines, a plurality of first channel lines, and a plurality of light emitting elements that are arranged in a matrix with a plurality of rows and a plurality of columns; each of said light emitting elements including a first light emitting diode (LED) that has a first terminal and a second terminal; for each of said rows of said light emitting elements, said second terminals of said first LEDs of said light emitting elements being connected to a respective one of said scan lines; for each of said columns of said light emitting elements, said first terminals of said first LEDs of said light emitting elements being connected to a respective one of said first channel lines; and a driving circuit including a delay-locked loop (DLL) for receiving a reference clock signal, and generating an internal global clock signal based on the reference clock signal, a signal processor connected to said DLL for receiving the internal global clock signal therefrom, for further receiving display data, and generating a scan control output and a channel control output based on the internal global clock signal and the display data, a scan driver connected to said scan lines, further connected to said signal processor for receiving the scan control output therefrom, and driving said scan lines based on the scan control output, and a channel driver connected to said first channel lines, further connected to said signal processor for receiving the channel control output therefrom, and providing a plurality of first driving current signals respectively to said first channel lines based on the channel control output.

2. The display system of claim 1, wherein said signal processor further provides a multiple control setting, and said DLL includes:

a phase detector for receiving the reference clock signal and a feedback clock signal, and generating a detection output related to a phase difference between the reference clock signal and the feedback clock signal;

a charge pump connected to said phase detector for receiving the detection output therefrom, and generating a pump current signal based on the detection output;

a loop filter connected to said charge pump for receiving the pump current signal therefrom, and generating a control voltage based on the pump current signal;

a voltage-controlled delay line connected to said loop filter for receiving the control voltage therefrom, for further receiving the reference clock signal, further connected to said phase detector, and generating, based on the control voltage and the reference clock signal, a plurality of delayed clock signals with respective phase deviations from the reference clock signal that are different from each other and that are related to the control voltage; one of the delayed clock signals serving as the feedback clock signal for receipt by said phase detector; and an output generator connected to said voltage-controlled delay line for receiving the delayed clock signals therefrom, further connected to said signal processor for receiving the multiple control setting therefrom, and performing logical operations upon the delayed clock signals based on the multiple control setting to generate the internal global clock signal for receipt by said signal processor.

3. The display system of claim 1, wherein the scan control output includes a scan clock signal and a scan control setting, and said scan driver includes:

a scan controller connected to said signal processor for receiving the scan control output therefrom, and generating a plurality of scan control signals, which respectively correspond to said scan lines, based on the scan control output in such a way that at least some of the scan control signals transition between two different logical states in synchrony with the scan clock signal and that a number of the at least some of the scan control signals is related to the scan control setting; and a plurality of scan switches each having a first terminal that is connected to a respective one of said scan lines, a second terminal that is adapted to be connected to a power rail, and a control terminal that is connected to said scan controller for receiving therefrom one of the scan control signals which corresponds to the respective one of said scan lines.

4. The display system of claim 3, wherein said scan driver further includes:

a plurality of amplifiers, each of which is connected to a respective one of said scan lines, each of which is further connected to said scan controller for receiving therefrom one of the scan control signals that corresponds to the respective one of said scan lines, and each of which adjusts a magnitude of a voltage at the respective one of said scan lines to a predetermined reference voltage value when said one of the scan control signals causes one of said scan switches that is connected to the respective one of said scan lines to not conduct.

5. The display system of claim 3, wherein each of said scan switches is an N-type power semiconductor transistor, and is for receiving a ground voltage from the power rail.

6. The display system of claim 3, wherein each of said scan switches is a P-type power semiconductor transistor, and is for receiving, from the power rail, a supply voltage with a magnitude that falls within a range of 3.2V to 5V.

7. The display system of claim 1, wherein:

said light emitting array further includes a plurality of second channel lines and a plurality of third channel lines;

for each of said columns of said light emitting elements, said light emitting elements are further connected to a respective one of said second channel lines and a respective one of said third channel lines; and said channel driver is further connected to said second channel lines and said third channel lines, and provides a plurality of second driving current signals respectively to said second channel lines and a plurality of third driving current signals respectively to said third channel lines based on the channel control output.

8. The display system of claim 7, wherein:

the channel control output includes a plurality of first pulse width modulation (PWM) signals that respectively correspond to said first channel lines, a plurality of second PWM signals that respectively correspond to said second channel lines, and a plurality of third PWM signals that respectively correspond to said third channel lines; each of the first to third PWM signals having a pulse width related to the display data;

said channel driver includes a current provider providing a plurality of first driving currents that respectively correspond to said first channel lines, a plurality of second driving currents that respectively correspond to said second channel lines, and a plurality of third driving currents that respectively correspond to said third channel lines, a plurality of first channel switches respectively corresponding to said first channel lines, a plurality of second channel switches respectively corresponding to said second channel lines, and a plurality of third channel switches respectively corresponding to said third channel lines, each of said first to third channel switches having a first terminal that is connected to said current provider, a second terminal that is connected to a corresponding one of said first to third channel lines, and a control terminal that is connected to said signal processor for receiving therefrom one of the first to third PWM signals which corresponds to the corresponding one of said first to third channel lines, each of said first to third channel switches permitting one of the first to third driving currents, which corresponds to the corresponding one of said first to third channel lines, to flow through said channel switch when said channel switch conducts; and the first to third driving current signals are respectively provided at said second terminals of said first to third channel switches.

9. The display system of claim 8, wherein:

the channel control output further includes a current gain control setting;

said channel driver further includes a current gain controller that is connected to said signal processor for receiving the current gain control setting therefrom, and that generates a first current gain control signal, a second current gain control signal and a third current gain control signal based on the current gain control setting; and said current provider is further connected to said current gain controller for receiving the first to third current gain control signals therefrom, adjusts magnitudes of the first driving currents based on the first current gain control signal, adjusts magnitudes of the second driving currents based on the second current gain control signal, and adjusts magnitudes of the third driving currents based on the third current gain control signal.

10. The display system of claim 8, wherein:

said channel driver further includes an amplifier unit that is connected to said first to third channel lines, and that is further connected to said signal processor for receiving the first to third PWM signals therefrom; and for each of said first to third channel lines, said amplifier unit adjusts a magnitude of a voltage at said channel line to a corresponding reference voltage value when one of the first to third PWM signals that corresponds to said channel line causes one of said first to third channel switches that corresponds to said channel line to not conduct.

11. The display system of claim 8, wherein:

said current provider is adapted to be further connected to a first power rail for receiving therefrom a first supply voltage with a magnitude that falls within a range of 2.4V to 4.5V, and a second power rail for receiving therefrom a second supply voltage with a magnitude that falls within a range of 3.2V to 4.5V; and the first driving currents are sourced from the first power rail, and the second and third driving currents are sourced from the second power rail.

12. The display system of claim 7, wherein:

said first LED of each of said light emitting elements is a red LED;

each of said light emitting elements further includes a green LED and a blue LED; and for each of said light emitting elements, each of said green and blue LEDs has a first terminal and a second terminal; said first terminals of said green and blue LEDs are respectively connected to one of said second channel lines that corresponds to said light emitting element and one of said third channel lines that corresponds to said light emitting element; and said second terminals of said red, green and blue LEDs are connected to one of said scan lines that corresponds to said light emitting element.

13. The display system of claim 1, wherein:

said signal processor includes a controller connected to said DLL for receiving the internal global clock signal therefrom, for further receiving a data clock signal, generating a channel clock signal and a scan clock signal in synchrony with the internal global clock signal, and generating a configuration clock signal in synchrony with the data clock signal, an input/output (I/O) interface for receiving the data clock signal, and for further receiving the display data and a plurality of control settings in synchrony with the data clock signal, a configuration register connected to said controller for receiving the configuration clock signal therefrom, and further connected to said I/O interface for receiving and storing the control settings therefrom in synchrony with the configuration clock signal, and a pulse width modulator connected to said controller for receiving the channel clock signal therefrom, further connected to said I/O interface for receiving the display data therefrom, and performing PWM based on the display data in synchrony with the channel clock signal to generate a plurality of PWM signals;

the scan control output including the scan clock signal generated by said controller, and one of the control settings stored in said configuration register;

the channel control output including the PWM signals generated by said pulse width modulator, and another one of the control settings stored in said configuration register.

14. A driving circuit operatively associated with a light emitting array, the light emitting array including a plurality of scan lines, a plurality of first channel lines, and a plurality of light emitting elements that are arranged in a matrix with a plurality of rows and a plurality of columns; each of the light emitting elements including a first light emitting diode (LED) that has a first terminal and a second terminal; for each of the rows of the light emitting elements, the second terminals of the first LEDs of the light emitting elements being connected to a respective one of the scan lines; for each of the columns of the light emitting elements, the first terminals of the first LEDs of the light emitting elements being connected to a respective one of the first channel lines; said driving circuit comprising:

a delay-locked loop (DLL) for receiving a reference clock signal, and generating an internal global clock signal based on the reference clock signal;

a signal processor connected to said DLL for receiving the internal global clock signal therefrom, for further receiving display data, and generating a scan control output and a channel control output based on the internal global clock signal and the display data;

a scan driver adapted to be connected to the scan lines, further connected to said signal processor for receiving the scan control output therefrom, and driving the scan lines based on the scan control output; and a channel driver adapted to be connected to the first channel lines, further connected to said signal processor for receiving the channel control output therefrom, and providing a plurality of first driving current signals respectively to the first channel lines based on the channel control output.

15. The driving circuit of claim 14, the light emitting array further including a plurality of second channel lines and a plurality of third channel lines; for each of the columns of the light emitting elements, the light emitting elements being further connected to a respective one of the second channel lines and a respective one of the third channel lines; wherein: said channel driver is adapted to be further connected to the second channel lines and the third channel lines, and provides a plurality of second driving current signals respectively to the second channel lines and a plurality of third driving current signals respectively to the third channel lines based on the channel control output.

16. The driving circuit of claim 15, wherein:

the channel control output includes a plurality of first pulse width modulation (PWM) signals that respectively correspond to the first channel lines, a plurality of second PWM signals that respectively correspond to the second channel lines, and a plurality of third PWM signals that respectively correspond to the third channel lines; each of the first to third PWM signals having a pulse width related to the display data;

said channel driver includes a current provider supplying a plurality of first driving currents that respectively correspond to said first channel lines, a plurality of second driving currents that respectively correspond to said second channel lines, and a plurality of third driving currents that respectively correspond to said third channel lines, a plurality of first channel switches respectively corresponding to said first channel lines, a plurality of second channel switches respectively corresponding to said second channel lines, and a plurality of third channel switches respectively corresponding to said third channel lines, each of said first to third channel switches having a first terminal that is connected to said current provider, a second terminal that is connected to a corresponding one of said first to third channel lines, and a control terminal that is connected to said signal processor for receiving therefrom one of the first to third PWM signals which corresponds to the corresponding one of said first to third channel lines, each of said first to third channel switches permitting one of the first to third driving currents, which corresponds to the corresponding one of said first to third channel lines, to flow through said channel switch when said channel switch conducts; and the first to third driving current signals are respectively provided at said second terminals of said first to third channel switches.

17. The driving circuit of claim 16, wherein:

said current provider is adapted to be further connected to a first power rail for receiving therefrom a first supply voltage with a magnitude that falls within a range of 2.4V to 4.5V, and a second power rail for receiving therefrom a second supply voltage with a magnitude that falls within a range of 3.2V to 4.5V; and the first driving currents are sourced from the first power rail, and the second and third driving currents are sourced from the second power rail.

18. The driving circuit of claim 14, wherein the scan control output includes a scan clock signal and a scan control setting, and said scan driver includes:

a scan controller connected to said signal processor for receiving the scan control output therefrom, and generating a plurality of scan control signals based on the scan control output in such a way that at least some of the scan control signals transition between two different logical states in synchrony with the scan clock signal and that a number of the at least some of the scan control signals is related to the scan control setting; and a plurality of scan switches each having a first terminal that is adapted to be connected to a respective one of the scan lines, a second terminal that is connected to a power rail, and a control terminal that is connected to said scan controller for receiving a respective one of the scan control signals therefrom.

19. The driving circuit of claim 18, wherein each of said scan switches is an N-type power semiconductor transistor, and is for receiving a ground voltage from the power rail.

20. The driving circuit of claim 18, wherein each of said scan switches is a P-type power semiconductor transistor, and is for receiving, from the power rail, a supply voltage with a magnitude that falls within a range of 3.2V to 5V.

* * * * *